United States Patent [19]

Grimm et al.

[11] 3,968,726

[45] July 13, 1976

[54] CARTRIDGE RECEIVING DRUM CONSTRUCTION FOR GAS-TIGHT CLOSURE BETWEEN THE DRUM AND THE ADJACENT GUN BARREL

[75] Inventors: Oskar Grimm, Epfendorf; Ludwig Vorgrimler, Oberndorf, Neckar; Peter Bernhard, Dietingen, all of Germany

[73] Assignee: Industriewerke Karlsruhe-Augsburg Aktiengesellschaft, Germany

[22] Filed: Sept. 12, 1974

[21] Appl. No.: 505,250

[30] Foreign Application Priority Data

Sept. 22, 1973 Germany ..... 2347855

[52] U.S. Cl. ..... 89/26

[51] Int. Cl.[2] ..... F41D 7/04

[58] Field of Search ..... 42/59; 89/26, 155, 156, 89/157

[56] References Cited

UNITED STATES PATENTS 3,768,362 10/1973 Grimm et al. ..... 89/26

*Primary Examiner*—Stephen C. Bentley

*Attorney, Agent, or Firm*—McGlew and Tuttle

[57] ABSTRACT

A cartridge receiving drum construction for providing gas-tight closure of a separation interstice between a gun barrel and cartridge receiving drum which is rotatably mounted in a housing of the gun adjacent the loading end of the barrel, comprising a drum having a plurality of through bores defining projectile guideways for receiving a cartridge which are alignable with the gun barrel. The end of the drum adjacent the gun barrel defines a front surface with a circular groove therein concentrically arranged around each projectile guideway. An elastic seal capable of withstanding a very high temperature is arranged in the groove and a plurality of relatively small diameter bores extend inwardly from the inner end of the groove and are connected laterally into a similar small diameter bore into the guideway at a spaced location from the front face of the drum barrel. The high pressure powder gases produced upon the ignition of the cartridge flow as one or more partial streams into the small bores which are circumferentially arranged around the guideway and floss through the bores into the grooves to form residual gas streams which deform the seal to ensure a sealing at one side of the groove and a backing at the other side. The groove has an outside diameter approxmately 8% larger than the largest case diameter of a cartridge to be fired.

5 Claims, 2 Drawing Figures

CARTRIDGE RECEIVING DRUM CONSTRUCTION FOR GAS-TIGHT CLOSURE BETWEEN THE DRUM AND THE ADJACENT GUN BARREL

BACKGROUND OF THE INVENTION

1. Field of the Invention

This invention relates in general to the construction of weapons and, in particular, to a new and useful arrangement for the automatic sealing of an end face of a revolving cartridge holder drum and the adjacent barrel.

2. Description of the Prior Art

The present invention deals with an improvement in the construction of guns which have revolving drums for cartridges, particularly for revolver guns with high ballistic performances and correspondingly designed ammunition. With such a construction, the interstice between the end of the revolving cartridge drum and the barrel of the gun must be sealed during the firing and this is accomplished by an annular ring seal which is retained in a groove around the cartridge passageways which are defined in the drum and which are directed by the action of the ignited cartridge gases to seal the associated drum with the barrel. This known arrangement provides a long-life sealing system which is simple and reliable in construction and operation and which in use or in action can easily be disassembled and reassembled without special tools or assemblage devices.

SUMMARY OF THE INVENTION

In accordance with the present invention, the sealing action is improved by a particular critical construction of the sealing groove which is defined around the cartridge projectile guideways at the face of the drum which is adjacent the barrel. In the construction of the invention, the outer diameter of the annular seal ring which fits into the receiving groove is made approximately 8% larger than the largest case diameter of a cartridge to be fired and the seal ring advantageously has a relatively narrow ring area.

In a further development of the invention, each of the seal rings arranged in the drum in circumferentially spaced relationship is subjected to the action of partial streams which are branched from the main gas stream of the drum projectile guideways and which pass as partial streams through a plurality of circumferentially arranged bores of relatively small diameter. There are preferably four equally spaced bores arranged to interconnect the bottom of each groove at the barrel facing end of the drum with the interior projectile guideway at a spaced location from the face. In the preferred form, the small diameter bores which connect to the grooves extend obliquely at a small angle in a direction away from the axis of the projectile guideways of the drums and they interconnect at their inner end to a transverse bore which extends into the guideway at a spaced location from the barrel facing end. The diameter of each of the small diameter bores is advantageously equal to or less than 1.0mm.

Aside from the fact that the construction of the present invention has the same advantages as the previously disclosed construction mentioned as prior art in respect to the fact that it is a pending application, the present invention has the further following advantages:

Due to the optimum value of approximately 8% by which the outer diameter of the seal ring is larger than the largest case diameter of a cartridge to be fired and which has been determined both by theoretic considerations and practical tests, the drum of the revolver gun can also be designed in an optimum manner. That is, with an outer diameter of the seal ring larger than 8%, the groove into which it is inserted should also be larger. However, such a design would diminish the cross-section between the individual circumferentially distributed projectile guideways in an inadmissible and undesirable manner. The result would be permanent deformations requiring replacement of the defective drum. It is evident that such a result is highly undesirable particularly during use of the weapon in action. The outer diameter of the seal ring if made smaller than approximately 8% of the largest case diameter of the cartridge to be fired would have an equally undesirable result in that the arm would no longer be open.

Accordingly, it is an object of the invention to provide an arrangement of the sealing between a revolving drum for cartridges and the associated barrel through which the projectiles of the cartridge are to be fired, wherein the drum face on the side adjacent the barrel is provided with annular grooves containing elastic sealing rings wherein the grooves have an outside diameter of approximately 8% larger than the largest case diameter of the cartridge to be fired.

A further object of the invention is to provide an arrangement for the gas-tight closure of a separation interstice of a gun barrel and an associated revolving cartridge receiving drum which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference should be had to the accompanying drawing and descriptive matter in which there is illustrated a preferred embodiment of the invention.

DESCRIPTION OF THE PREFERRED EMBODIMENT

Figure 1:
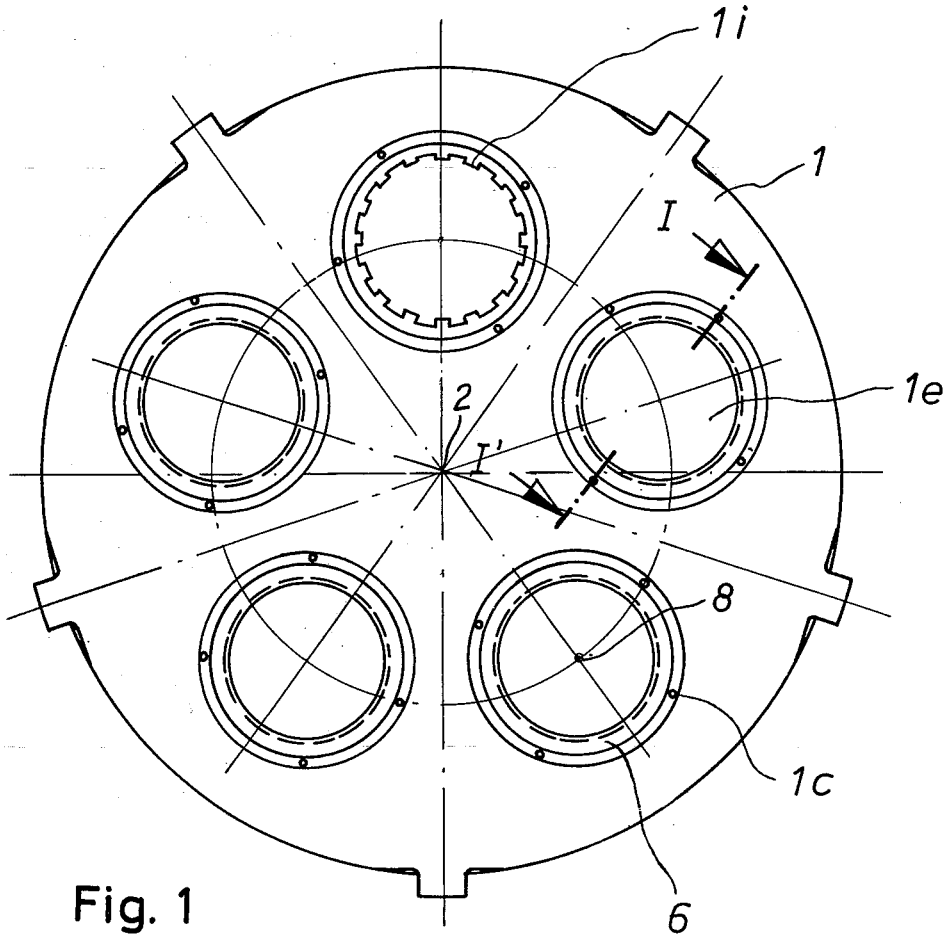
FIG. 1 is a front elevational view of a rotatable drum for a gun constructed in accordance with the invention.
Figure 2:
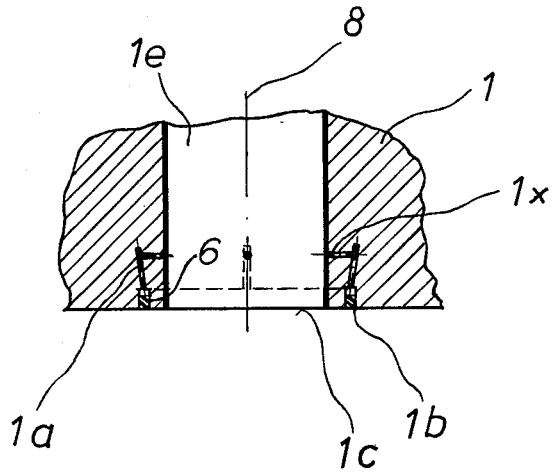
FIG. 2 is a partial sectional view taken along the line I—I of FIG. 1.

Referring to the drawings in particular, the invention embodied therein, comprises a rotatable cartridge receiving drum 1 having a plurality of through bores defining projectile guideways 1*e* which have internal rifling or guide ribs 1*i*. The guide ribs 1*i* extend in an axial direction and provide means for guiding the projectile. The drum 1 is mounted for rotation about a central axis 2. Drum 1 has a barrel facing drum surface 1*c* with a circular groove 1*b* concentrically arranged thereon around the guideways 1*e* and having a larger diameter than the guideways. The circular groove 1*b* is dimensioned so that its outer diameter is approximately 8% larger than the largest case diameter of the cartridge to be discharged from the firearm.

In accordance with another feature of the invention, a plurality of small diameter gas supply passages 1*a* extend obliquely inwardly from the barrel facing face 1*c* and diverge in a direction outwardly from the adjacent projectile guideway 1*e*. The inner ends of the small diameter passages 1*a* are connected by transverse small diameter bores which extend inwardly from the interior of the guideways to the small bores 1*b*. The small diameter bores 1*x* are substantially perpendicular to the axis 8 of each projectile guideway 1*e*. An elastic seal ring 6 is positioned in the groove 1*b* and it is capable of withstanding very high temperatures.

While a specific embodiment of the invention has been shown and described in detail to illustrate the application of the principles of the invention, it will be understood that the invention may be embodied otherwise without departing from such principles.

What is claimed is:

1. A cartridge receiving drum construction providing a gas-tight closure of a separation interstice between a gun barrel and a cartridge receiving drum mounted coaxially of the gun barrel for rotation in a gun housing, particularly for revolver guns with high ballistic performances and correspondingly designed ammunition, comprising a drum having at least one projectile guideway for receiving a cartridge which is alignable with the gun barrel and having a front surface facing the end of the gun barrel with a circular groove arranged concentrically of the projectile guideway of said drum, an elastic seal ring in said groove capable of withstanding very high temperature, and at least one small bore defined in said drum between the inner end of said groove and said projectile guideway opening in said guideway at a spaced location from the gun barrel facing end, said small diameter bore providing a passage for a partial stream of high pressure powder gases upon ignition of the cartridge which stream acts to deform the seal in said groove to cause it to seal one side of the groove and back the other side and wherein said groove has an outside diameter approximately 8% larger than the largest case diameter of a cartridge to be fired.

2. A cartridge receiving drum construction, according to claim 1, wherein there are a plurality of projectile guideways defined in said drum at spaced circumferential locations, each having an associated groove and seal ring therein, each of said seal rings being in circumferentially distributed relationship and being subject to the action of partial gas streams passed off from an associated main gas stream generated in said projectile guideways during ignition of said cartridges, and including a plurality of interconnecting small diameter bores connecting the inner ends of said grooves with the interior of said guideways at a spaced location from the gun barrel facing end.

3. A cartridge receiving drum construction, according to claim 2, wherein said small diameter bores each include an inwardly extending portion connecting the inner end of the groove which extends obliquely away from the guideway and a transverse portion extending perpendicular to the axis of the guideway intersecting the obliquely extending portion.

4. A cartridge receiving drum construction, according to claim 1, wherein each of the small diameter bores includes an inwardly extending oblique portion which extends inwardly from the inner end of each groove and diverges away from the axis of the adjacent projectile guideway.

5. A cartridge receiving drum construction, according to claim 1, wherein said small diameter bores are of a diameter less than 1mm.

* * * * *